US008911616B2

(12) United States Patent
Banerjee et al.

(10) Patent No.: US 8,911,616 B2
(45) Date of Patent: Dec. 16, 2014

(54) HYDROTREATING PROCESS AND CONTROLLING A TEMPERATURE THEREOF

(75) Inventors: Soumendra Banerjee, Dwarka (IN); Richard Hoehn, Mt. Prospect, IL (US); Srinivasa Gopalan Varadarajan, Gurgaon (IN)

(73) Assignee: UOP LLC, Des Plaines, IL (US)

( * ) Notice: Subject to any disclaimer, the term of this patent is extended or adjusted under 35 U.S.C. 154(b) by 624 days.

(21) Appl. No.: 13/093,914

(22) Filed: Apr. 26, 2011

(65) Prior Publication Data

US 2012/0273394 A1 Nov. 1, 2012

(51) Int. Cl.
*C10G 45/38* (2006.01)

(52) U.S. Cl.
CPC ..... *C10G 45/38* (2013.01); *C10G 2300/1044* (2013.01)
USPC ..... 208/264; 208/59; 208/80

(58) Field of Classification Search
CPC ..... C10G 45/02; C10G 45/06; C10G 45/38; C10G 65/04; C10G 69/06; C10G 2300/1044; C10G 2300/44; C10G 2300/805
USPC ..... 208/48, 49, 57, 80, 144, 211, 218, 264
See application file for complete search history.

(56) References Cited

U.S. PATENT DOCUMENTS 3,003,953 A * 10/1961 Evans ..... 208/254 H
3,475,327 A * 10/1969 Eng et al. ..... 208/211
5,266,188 A * 11/1993 Kukes et al. ..... 208/216 R
5,364,995 A 11/1994 Kirkwood et al.
5,389,232 A 2/1995 Adewuyi et al.
5,851,383 A 12/1998 Frey
6,086,751 A 7/2000 Bienstock et al.
6,299,759 B1 * 10/2001 Bradway et al. ..... 208/59
6,531,516 B2 3/2003 Davis et al.
6,623,623 B2 * 9/2003 Kalnes ..... 208/89
6,632,351 B1 10/2003 Ngan et al.
6,709,571 B1 3/2004 Del Rossi et al.
6,746,599 B2 6/2004 Cymerman et al.
7,820,034 B2 10/2010 Bruha
8,491,779 B2 * 7/2013 Shafi et al. ..... 208/50
2002/0166798 A1 11/2002 Debuisschert et al.
2007/0095724 A1 5/2007 Baptista et al.
2007/0175798 A1 8/2007 Fokema et al.
2008/0146855 A1 6/2008 Negiz et al.
2009/0155150 A1 * 6/2009 Ripperger et al. ..... 423/230
2010/0270208 A1 10/2010 Ward et al.

OTHER PUBLICATIONS

Rahimi et al., "Hydrotreating of Liquid Products From Cold Lake Bitumen Obtained in the WRITE Process", Presented at the Division of Fuel Chemistry, 227th ACS National Meeting, Anaheim, CA, Mar. 28-Apr. 1, 2004.*

* cited by examiner

*Primary Examiner* — Prem C Singh
*Assistant Examiner* — Brandi M Doyle
(74) *Attorney, Agent, or Firm* — James C Paschall

(57) ABSTRACT

One exemplary embodiment can be a hydrotreating process. The hydrotreating process can include providing a first feed stream having a coker naphtha with a bromine number of about 10-about 120, combining the first feed stream with a second feed stream having a straight run naphtha with a bromine number of less than about 10 to create a combined feed, providing the combined feed to a hydrotreating reactor having at least one catalyst bed, and separating a quench stream from the second feed stream and providing the quench stream after the at least one catalyst bed.

18 Claims, 1 Drawing Sheet

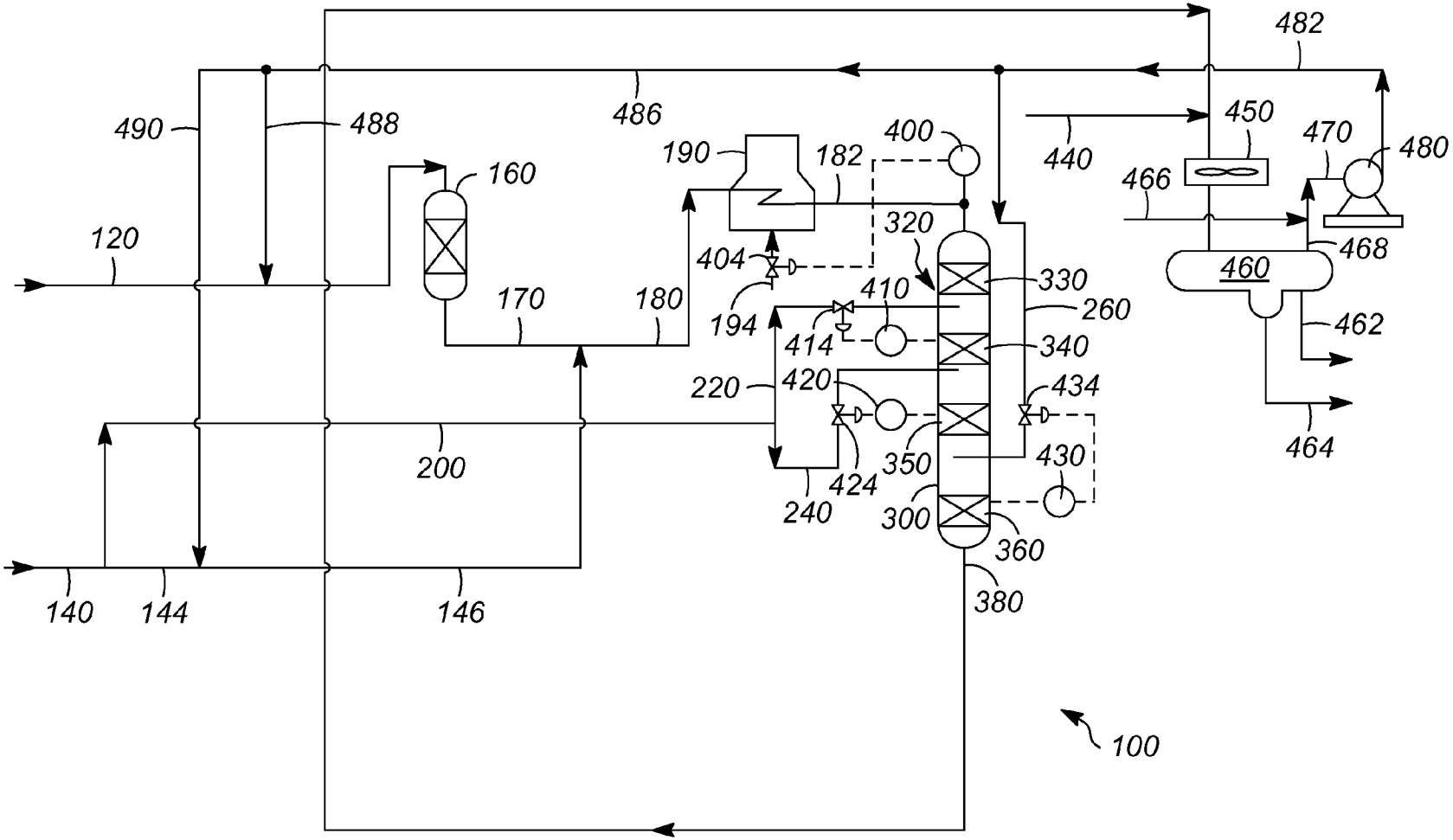
100
120
140
144
146
160
170
180
182
190
194
200
220
240
260
300
320
330
340
350
360
380
400
404
410
414
420
424
430
434
440
450
460
462
464
466
468
470
480
482
486
488
490

HYDROTREATING PROCESS AND CONTROLLING A TEMPERATURE THEREOF

FIELD OF THE INVENTION

This invention generally relates to a hydrotreating process and controlling a temperature thereof.

DESCRIPTION OF THE RELATED ART

In hydrotreating coker naphtha, an excessive heat of reaction can be generated. Additionally, these reactions are often carried out in a vapor phase that can lead to a very high and unwanted temperature rise in the reactor beds of the hydrotreating unit. The high temperature rise across a bed can cause rapid catalyst deactivation and difficulty in controlling the temperature in subsequent beds. Moreover, lowering the temperature of the charge furnace outlets might be required to keep the top bed outlet temperature within the design temperature of the reactor, as the temperature rise can be in the range of about 60-about 100° C. However, there is a limit to lowering the furnace outlet temperature due to furnace turn down issues. As a consequence, various techniques may be employed to mitigate the temperature rise.

One technique can include recycling a separated liquid or product naphtha to serve as a heat sink to limit the rise in reactor bed temperatures. Although this technique can be effective for limiting temperature rise, the recycling may also require increasing the hydraulic capacity of the reaction section or the unit as a whole, depending on, e.g., the volume of the recycled stream.

As a consequence, this recycling can significantly increase the cost of the unit. As such, it would be desirable to develop a process that can limit temperature rise while minimizing or even eliminating the recycle stream and thus avoiding the aforementioned shortcomings.

SUMMARY OF THE INVENTION

One exemplary embodiment can be a hydrotreating process. The hydrotreating process can include providing a first feed stream having a coker naphtha with a bromine number of about 10-about 120, combining the first feed stream with a second feed stream having a straight run naphtha with a bromine number of less than about 10 to create a combined feed, providing the combined feed to a hydrotreating reactor having at least one catalyst bed, and separating a quench stream from the second feed stream and providing the quench stream after the at least one catalyst bed.

Another exemplary embodiment may be a process for controlling a temperature in a reactor. The process can include providing the reactor a quench stream including a naphtha and a bromine number of less than about 10, and a feed stream including a naphtha having a diene value of greater than about 2 and a bromine number of about 10-about 120.

A further exemplary embodiment can be a process for hydrotreating a coker naphtha while minimizing a liquid recycle. The process can include providing a naphtha having an effective amount of olefins and diolefins as a quench stream to a hydrotreating reactor.

The embodiments disclosed herein can provide a second naphtha stream in addition to a coker naphtha stream. As a result, the second naphtha stream typically is a straight run naphtha having a diene value of less than about 2 and a bromine number of less than about 10. As a consequence, this stream can have sufficiently low amounts of olefins and diolefins to act as a heat sink in the reactor. Particularly, the second stream can serve as a heat sink by quenching and utilizing sensible as well as latent heat. As a result, the vaporization of the second stream can remove some of the reaction heat without the need of recycling another liquid stream.

DEFINITIONS

As used herein, the term "stream" can include various hydrocarbon molecules, such as straight-chain, branched, or cyclic alkanes, alkenes, alkadienes, and alkynes, and optionally other substances, such as gases, e.g., hydrogen, or impurities, such as heavy metals, and sulfur and nitrogen compounds. The stream can also include aromatic and non-aromatic hydrocarbons. Moreover, the hydrocarbon molecules may be abbreviated C1, C2, C3 . . . Cn where "n" represents the number of carbon atoms in the one or more hydrocarbon molecules.

As used herein, the term "zone" can refer to an area including one or more equipment items and/or one or more sub-zones. Equipment items can include one or more reactors or reactor vessels, heaters, exchangers, pipes, pumps, compressors, and controllers. Additionally, an equipment item, such as a reactor, dryer, or vessel, can further include one or more zones or sub-zones.

As depicted, process flow lines in the FIGURE can be referred to interchangeably as, e.g., lines, pipes, feeds, portions, remainders, products, or streams.

As used herein, the term "naphtha" can refer to a mixture of one or more C5-C12 hydrocarbons.

As used herein, the term "coker naphtha" can refer to a mixture of one or more C5-C12 hydrocarbons and a diene value of greater than about 2 and a bromine number of about 10-about 120. Generally, a coker naphtha can be obtained from a carbonaceous residue, a vacuum residue, and/or an atmospheric residue by the application of heat and fractionation.

As used herein, the term "straight run naphtha" can refer to a mixture of one or more C5-C12 hydrocarbons and a diene value of less than about 2 and a bromine number of less than about 10. Generally a straight run naphtha is obtained from distilling crude oil.

As used herein, the term "rich" can mean an amount of at least generally about 50%, and preferably about 70%, by mole, of a compound or class of compounds in a stream.

As used herein, the term "substantially" can mean an amount of at least generally about 80%, preferably about 90%, and optimally about 99%, by mole, of a compound or class of compounds in a stream.

As used herein, the terms "alkene" and "olefin" may be used interchangeably.

As used herein, the terms "alkadiene" and "diolefin" may be used interchangeably.

As used herein, the term "vapor" can mean a gas or a dispersion that may include or consist of one or more hydrocarbons. Often, a vapor may include a gas containing hydrocarbon droplets.

As used herein, the term "diene value" represents the weight percent of diolefin in a stream or sample times 250 divided by the average molecular weight of the stream or sample.

As used herein, the term "bromine number" indicates olefin content as determined by ASTM D1159-07.

BRIEF DESCRIPTION OF THE DRAWING

The FIGURE is a schematic depiction of an exemplary hydrotreatment zone.

DETAILED DESCRIPTION

Referring to the FIGURE, an exemplary hydrotreatment zone 100 can include a diolefin saturation reactor 160, and a hydrotreating reactor 300. The hydrotreatment zone 100 can receive a first feed stream 120 and a second or another feed stream 140. The first feed stream 120 can include a naphtha with a diene value of greater than about 2 and a bromine number of about 10-about 120, and is usually a coker naphtha. The olefins in the first feed stream 120 can range anywhere from about 15-about 55%, by volume, and hence a reactor bed temperature rise can be high due to the heat of reaction associated with olefin saturation. The second feed stream 140 can include an effective amount of olefins and diolefins, typically with a diene value of less than about 2 and a bromine number of less than about 10. Typically, the second feed stream 140 can be a straight run naphtha and has sufficiently low amounts of olefins and diolefins to act as a quench in the hydrotreating reactor 300. Generally, the presence of olefins can cause an increase in the heat of reaction due to the exothermic reactions of such compounds. Usually, the first feed stream 120 and the second feed stream 140 can, independently, include one or more C5-C12 hydrocarbons.

The first feed stream 120 can be provided to the diolefin saturation reactor 160. The coker naphtha can be charged to the diolefin saturation reactor 160 to limit diolefins that are present. Reactions can be carried out at relatively low temperatures. Use of the diolefin saturation reactor 160 can prevent fouling of the pre-heating equipment and pressure drop buildup in the top of the hydrotreating reactor 300. The diolefin saturation reactor 160 can include any suitable catalyst, such as a metal hydrogenation component of groups 8-10 of the periodic table supported on a refractory inorganic oxide support. Typically, the support can be alumina, but other inorganic oxides can be utilized such as non-zeolitic molecular sieves. The hydrogenation metal can include cobalt, nickel, or molybdenum. Usually, the diolefin saturation reactor 160 includes a fixed bed of catalyst operated in a downflow mode in a liquid phase at a temperature of about 90-about 145° C. and a pressure of about 2,400-about 4,200 kPa. Exemplary diolefin saturation processes are disclosed in, e.g., U.S. Pat. No. 5,851,383. Another exemplary diolefin saturation process can operate at a temperature of about 30-about 300° C. and a pressure of about 0-about 7,000 kPa, as disclosed in, e.g., US 2008/0146855 A1.

An effluent or a treated coker naphtha 170 having a diene value of less than about 2 can be combined with another portion 144 of the second feed stream 140. Generally, the second feed stream 140 can be split into the another portion 144 and a portion 200 of the straight run naphtha or a quench stream 200. The portion 200 of the straight run naphtha can be diverted and used as a quench for the main reactor beds. The another portion 144 can receive a recycle hydrogen stream 490, as hereinafter described, to form a combined stream 146. The combined stream 146 and the treated coker naphtha or effluent 170 may form a combined feed 180. This material can be heated to reach the required reactor inlet temperature. The combined feed 180 can be provided to a heater 190, which can be any suitable heat source, such as a furnace or a pressurized steam heat exchanger. In this exemplary embodiment, the heater 190 can be a furnace and receive a fuel stream 194. The combined feed 180 after passing through the heater 190 can be provided as a heated combined feed 182 to the hydrotreating reactor 300.

The hydrotreating reactor 300 can include at least one catalyst bed 320, typically a first catalyst bed 330, a second catalyst bed 340, a third catalyst bed 350, and a fourth catalyst bed 360. The hydrotreating reactor 300 can include at least three catalyst beds. Although four catalyst beds 330, 340, 350, and 360 are depicted, it should be understood that any suitable number of catalyst beds may be utilized. Generally, the hydrotreating reactor 300 can contain any suitable hydrotreating catalyst, such as a catalyst containing nickel and molybdenum, or cobalt, nickel, and molybdenum. These catalytic metals can be provided on any suitable support, such as an alumina or silica oxide support, in any catalytically effective amount. The hydrotreating reactor 300 can operate at any suitable temperature, such as about 200-about 400° C. and at any suitable pressure, such as a pressure of up to about 5,000 kPa. Generally, the hydrotreating reactor 300 can receive the quench stream 200, which can be split into a first quench stream 220 and a second quench stream 240. Typically, the first quench stream 220 can be provided after the first catalyst bed 330 and the second quench stream 240 can be provided after the second catalyst bed 340. In addition, a third or another quench stream 260, typically including a recycled fluid such as hydrogen, can be provided after the third catalyst bed 350, as hereinafter described. An effluent 380 can exit the hydrotreating reactor 300 and optionally pass to a post-treatment reactor.

If present, the post-treatment reactor can include any suitable hydrotreating catalyst for lowering undesired contaminants, such as sulfur and nitriles, and prevent the formation of mercaptans via recombination reactions. The catalyst may include a metal of iron, cobalt, nickel, molybdenum, or tin on any suitable support, such as a support of alumina or silica. Exemplary catalysts are disclosed in, e.g., US 2007/0175798 A1. Generally, the post-treatment reactor can operate at any suitable condition, such as a temperature of about 200-about 600° C., preferably about 300-about 600° C., and a pressure of about 700-about 5,000 kPa.

The effluent 380 can be combined with a wash water stream 440, passed to a condenser 450, and then to a cold separator 460. Generally, a water stream 464 can exit the bottom at a boot of the cold separator 460 while a hydrocarbon product stream 462 can exit from the lower part of the cold separator 460 and pass to any suitable downstream processing, such as a stripper column. Usually, the hydrocarbon product stream 462 can be further processed to form a desirable product, such as gasoline. A make-up gas stream 466, typically hydrogen, can be combined with a gas 468 from the cold separator 460 to form a combined stream 470 received at a suction of a compressor 480. The compressor discharge stream 482 can be split into the quench stream 260 to the hydrotreating reactor 300 and a remainder 486, which in turn can be split into a recycle hydrogen stream 488 to the diolefin saturation reactor 160 and the recycle hydrogen stream 490 to be combined with the portion 144. Generally, the streams 260, 488, and 490 can be controlled to allow any suitable amount of hydrogen at any one of these stages. The third quench stream 260 including recycled hydrogen can be provided downstream of the third catalyst bed 350. Although three quench streams 220, 240, and 260 are depicted, any suitable number of quench streams may be utilized.

In operation, the second feed stream 140 can be split into a quench stream 200 and a portion 144 to be mixed with the recycle hydrogen stream 490 to form the combined stream 146. The combined stream 146 may, in turn, be combined with the effluent 170 from the diolefin saturation reactor 160. Both the first feed stream 120 and the portion 144 may optionally receive hydrogen from, respectively, the recycle hydrogen stream 488 and the recycle hydrogen stream 490. The combined stream 180 can be passed through the heater 190, which can be controlled by regulating the amount of fuel stream 194 passing through a control valve 404. Particularly, the temperature at the top of the hydrotreating reactor 300 can be measured with a temperature indicator controller 400 and a control valve 404 to regulate the amount of fuel provided to the heater 190. The heated combined feed 182 can be provided to the hydrotreating reactor 300.

After passing through the first catalyst bed 330, the amount of a first quench stream 220 can again be regulated with a temperature indicator controller 410 that may measure the temperature in the second catalyst bed 340 and regulate the amount of the first quench stream 220 passing through a valve 414. The first quench stream 220 can be provided into the hydrotreating reactor 300 through any suitable device, such as a distributor, downstream of the first catalyst bed 330. The products can pass from the second catalyst bed 340 to the third catalyst bed 350. A temperature indicator controller 420 can again measure the temperature and send a signal to regulate a valve 424 for controlling the amount of a second quench stream 240 entering the hydrotreating reactor 300 downstream of the second catalyst bed 340. The second quench stream 240 can enter the hydrotreating reactor 300 through any suitable device, such as a distributor, downstream of the second catalyst bed 340.

What is more, a temperature indicator controller 430 in the fourth catalyst bed 360 can measure the temperature in that bed 360. As such, the temperature indicator controller 430 can send the signal to a valve 434 for regulating the amount of recycled hydrogen utilized as a quench stream 260 downstream of the third catalyst bed 350. Again, any suitable device, such as a distributor, can be utilized for providing the third quench stream 260 downstream of the third catalyst bed 350. In this manner, the temperature indicator controllers 400, 410, 420, and 430 can regulate the heater 190 and provide suitable quench within the hydrotreating reactor 300 and prevent a runaway reaction. As an example, the amount of quench can be increased should the temperature rise, or correspondingly, the amount of quench decreased should the temperature within the hydrotreating reactor 300 require raising. To provide for adequate treatment, the straight run naphtha quench can be limited to the top one or two reactor beds, such as the first catalyst bed 330 and second catalyst bed 340. If quench is required for subsequent beds, recycle gas would be used instead of the straight run naphtha.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing, all temperatures are set forth in degrees Celsius and, all parts and percentages are by weight, unless otherwise indicated.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A hydrotreating process, comprising:

A) providing a first feed stream comprising a coker naphtha with a bromine number of about 10-about 120;

B) combining the first feed stream with a second feed stream comprising a straight run naphtha with a bromine number less than about 10 to create a combined feed;

C) providing the combined feed to a hydrotreating reactor having at least one catalyst bed; and D) separating a quench stream from the second feed stream and providing the quench stream after the at least one catalyst bed.

2. The hydrotreating process according to claim 1, wherein the at least one catalyst bed comprises a catalyst comprising nickel and molybdenum or cobalt, nickel, and molybdenum.

3. The hydrotreating process according to claim 1, wherein the hydrotreating reactor comprises first, second, and third catalyst beds.

4. The hydrotreating process according to claim 3, wherein the quench stream is split into a first quench stream and a second quench stream.

5. The hydrotreating process according to claim 4, wherein the first quench stream is provided after a first catalyst bed and the second quench stream is provided after a second catalyst bed.

6. The hydrotreating process according to claim 5, wherein the coker naphtha and straight run naphtha, independently, comprise one or more C5-C12 hydrocarbons.

7. The hydrotreating process according to claim 6, further comprising providing a third quench stream comprising hydrogen after the third catalyst bed.

8. The hydrotreating process according to claim 1, further comprising passing the first feed stream through a diolefin saturation reactor before combining a treated first feed stream with the second feed stream.

9. The hydrotreating process according to claim 8, wherein the treated first feed stream has a diene value of less than about 2.

10. The hydrotreating process according to claim 1, wherein the coker naphtha has a diene value of greater than about 2 prior to passing through the diolefin saturation reactor.

11. A process for controlling a temperature in a reactor, comprising:

providing to the reactor a quench stream comprising a naphtha having a bromine number of less than about 10, and a feed stream comprising a naphtha having a diene value of greater than about 2 and a bromine number of about 10-about 120 and splitting a portion of another feed stream comprising a straight run naphtha as the quench stream and combining a remaining portion of the another feed stream with the feed stream to the reactor.

12. The process according to claim 11, wherein the feed stream is passed through a diolefin saturation reactor to lower a diolefin content in the feed stream.

13. The process according to claim 11, further comprising combining the another portion of the another feed stream with an effluent of the diolefin saturation reactor.

14. The process according to claim 11, wherein the reactor is a hydrotreating reactor operating at the temperature of about 200-about 400° C.

15. The process according to claim 11, further comprising providing another quench stream comprising hydrogen downstream of the quench stream comprising the straight run naphtha.

16. A process for hydrotreating a coker naphtha while minimizing a liquid recycle, comprising:

providing a naphtha having an effective amount of olefins and diolefins as a quench stream to a hydrotreating reactor; and combining a portion of said naphtha with a coker naphtha with a bromine number of about 10-about 120; and providing the combined feed to a hydrotreating reactor having at least one catalyst bed.

17. The process according to claim 16, wherein the hydrotreating reactor comprises at least three catalyst beds and the quench stream is provided downstream of a first catalyst bed.

18. The process according to claim 16, wherein the effective amount of olefins and diolefins is determined by the naphtha having, respectively, a bromine number of less than about 10 and a diene value of less than about 2.

* * * * *